US007825314B2

(12) United States Patent
Pace et al.

(10) Patent No.: US 7,825,314 B2
(45) Date of Patent: Nov. 2, 2010

(54) TUNING KEY COVER SUPPORT ARM

(76) Inventors: Russell Pace, 21 Hackett Cir., Rockland, MA (US) 02370; Deanne Pace, 8 Dartmouth St., Natick, MA (US) 01760

( * ) Notice: Subject to any disclaimer, the term of this patent is extended or adjusted under 35 U.S.C. 154(b) by 0 days.

(21) Appl. No.: 12/462,497

(22) Filed: Aug. 3, 2009

(65) Prior Publication Data

US 2010/0132534 A1 Jun. 3, 2010

Related U.S. Application Data

(63) Continuation-in-part of application No. 12/074,386, filed on Mar. 3, 2008, now Pat. No. 7,569,759.

(60) Provisional application No. 60/949,436, filed on Jul. 12, 2007.

(51) Int. Cl.
*G10D 3/14* (2006.01)

(52) U.S. Cl. ..... 84/304

(58) Field of Classification Search ..... 84/312 R, 84/304–306

See application file for complete search history.

(56) References Cited

U.S. PATENT DOCUMENTS 4,030,399 A * 6/1977 Grottola ..... 84/304

* cited by examiner

*Primary Examiner*—Kimberly R Lockett
(74) *Attorney, Agent, or Firm*—Edwards Angell Palmer & Dodge LLP; Ralph A. Loren

(57) ABSTRACT

The invention relates to a protective tuner cover for the tuning section of a stringed musical instrument, such as a guitar. The tuner cover is sized to enclose the instrument headstock, or a substantial portion thereof, and includes a section that encloses and protects the tuning keys and knobs of the musical instrument. When constructed as a unitary structure, the tuner cover can be slid onto the instrument headstock. When constructed from separable components, the tuning cover can be opened and closed over the headstock in a bivalve manner if hinged, or by appropriately spaced latching mechanisms if completely separable. The tuner cover can be constructed to enclose and protect one or two rows of tuning keys and knobs, depending on the type of musical instrument.

7 Claims, 6 Drawing Sheets

TUNING KEY COVER SUPPORT ARM

RELATED APPLICATIONS

This is a continuation-in-part patent application that claims priority to U.S. patent application Ser. No. 12/074,386, filed on Mar. 3, 2008, which claims the benefit U.S. Provisional Application No. 60/949,436, filed on Jul. 12, 2007.

TECHNICAL FIELD

The present invention relates to protective covers for stringed musical instruments. One example of such a protective cover is a cover for the headstock of a stringed musical instrument such as a guitar. The protective cover helps to prevent inadvertent physical contact with the tuning keys, reducing the frequency of adjustments needed to keep the instrument in tune.

Some stringed musical instruments have fragile necks. This is particularly true of instruments having offset headstocks. A device that protects the tuning set and the neck from breaking if the instrument falls, or during shipping or transport, would be useful for these fragile instruments.

BACKGROUND OF THE INVENTION

A stringed musical instrument such as a guitar is typically protected from damage during storage or transport by a hard or soft case that encloses the entire instrument. Such traditional cases do not necessarily protect the instrument from being jarred out of tune. The tuning keys of the instrument, protruding from one or both sides of the instrument's head or headstock, are at risk from inadvertent physical contact. This contact can occur with the interior walls of a loosely fitting hard instrument case, the fabric of a soft instrument cover as it is being pulled over the instrument, or objects in the immediate environment that contact the tuning keys either directly or through a soft cover. Physical contact with the knobs of the tuning keys can cause them turn slightly, changing the pitch of the instrument's strings.

A hard instrument case may be able to protect the tuning keys from movement, but only if the interior of the case is custom-fitted to the particular dimensions of the instrument. A custom-made hard case of this type is relatively expensive, bulky and heavy. This type of protection is not even possible with a soft instrument cover. Thus, it would be highly desirable to have a protective cover for a stringed musical instrument that encloses the tuning keys and is secured against the instrument's headstock to prevent either the cover itself or any other object from contacting the knobs of the tuning keys.

In addition, for those instruments with fragile necks, such as guitars with offset headstocks like many of the Gibson guitars, the area between the headstock and the neck is prone to breakage. It would be desirable to have a device which protects this fragile neck portion and the headstock from damage from breakage in falls or transit without the necessity of the custom formed hard case.

SUMMARY OF THE INVENTION

The present invention provides an elongate, preferably rigid, protective tuner cover capable of enclosing the tuning keys on one or both sides of the headstock of a stringed musical instrument. The tuner cover is at least long enough to enclose all of the tuning keys including the tuning knobs. Preferably, the length of the tuner cover approximately matches that of the instrument headstock, and its shape roughly matches the shape or contour of the headstock. The tuner cover preferably includes an elongate arm which can support the neck of the instrument and prevents or minimizes the chance of breakage.

The headstock of the stringed instrument has a first side corresponding to the string-mounted side, an opposing second side; and it has a third side and fourth side on opposing sides of the headstock that are in generally perpendicular alignment with the first side and second side. The tuning knobs are mounted on or project above either the third side or fourth side, or both. The tuner cover is an elongate container that encloses the headstock and tuning knobs, and includes a tuner enclosure for enclosing the tuning knobs and/or the tuning keys. Headstocks having two rows of tuning keys and knobs, one row at the third side and another row at the fourth side of the headstock, can be enclosed by a tuning cover having two tuner enclosures, one for each row of tuning knobs or keys. The tuner cover can consist of two stabilizer/cover sections, one to enclose the first side and the other to enclose the second side of the instrument headstock. The first side stabilizer/cover encloses at least part of the face (first side) of the headstock on which the strings are located. The second side stabilizer/cover encloses at least part of the second side of the headstock. The two stabilizer/cover sections can be constructed to be a unitary assembly, or can be constructed to be separable.

Stabilization of the neck is provided by an arm or support that extends from the tuner cover and can be removably secured to the neck of the instrument. Preferably, the arm interlocks with the tuner cover in a pivoting manner that allows the tuner cover to be placed over the headstock and the arm is then pivoted into position and secured to the neck of the instrument. The arm provides an energy transfer away from the neck/headstock junction to prevent fracture of the instrument at the junction.

For guitars having a single row of tuning keys, the tuning keys and tuning knobs are lined up along the single third side or fourth side of the instrument headstock. To cover and protect these tuning knobs, the tuner enclosure section of the tuner cover extends from the first side stabilizer/cover to the second side stabilizer/cover, and defines an enclosure large enough to accommodate the tuning knobs without contacting them. The tuner cover is normally equipped with a tuner interlock bar on the inside of the first side stabilizer/cover, and runs along a substantial portion of the length of the first side stabilizer/cover near the side of the headstock having the tuning keys. The interlock bar projects inwardly from the inside surface of the stabilizer/cover. The interlock bar may jut over the third side or fourth side of the headstock or both, and the side of the interlock bar may make contact with that side of the headstock. The face of the interlock bar (roughly perpendicular to the side of the interlock bar) can make contact with the shafts of the tuning knobs, thereby helping to secure the tuner cover against the headstock. Alternatively, the face of the interlock bar can make contact with the first side of the headstock near the third side or the fourth side, whichever is associated with the tuning keys and knobs. The tuner cover is also normally equipped with a guide rail on the inside of the second side stabilizer/cover, which projects inwardly from the inside surface of the second side stabilizer/cover. The guide rail runs along a substantial portion of the length of the second side stabilizer/cover, and contacts the second side of the headstock near the area where the tuning keys attach to the headstock. The tuner interlock bar and the guide rail can apply opposing forces against the headstock to keep the tuner cover securely in place, so that the tuning knobs are protected from contact with the interior of the tuner enclosure section.

The tuner cover can be constructed of two components separable on one side, and attached together on the opposing side by a hinge or by a flexible polymeric or plastic material, allowing the tuner cover to open and close in a bivalve fashion. The separable sides of each tuner cover component can be configured to make contact with each other when the tuner cover is in a closed position. The separable sides of each tuner cover component can be releasably connected to each other when the tuner cover is in a closed position.

The neck support arm is particularly useful with instruments that have offset headstocks. Several guitars, such as many of the Gibson guitars, have headstocks that are offset from the plane of the fret board and base of the guitar, i.e., by about 13°. Because of this offset, jarring or dropping the guitar can cause a fracture of the junction between the headstock and the neck. Fractures of this type can be minimized by use of a neck support arm that is attached to the tuner cover, preferably with a pivot attachment that allows the arm to be moved into place. A lock mechanism may be used to lock the arm in place after it is in position and straps or other means of securing the arm to the neck of the musical instrument are included. While a pivoting arm is preferred, in certain instances the arm and tuner cover can be a unitary device without a pivot or they may be two separate pieces that snap or somehow join together to allow the transfer of energy to minimize damage in a fall.

DESCRIPTION

As used herein, the term "headstock" refers to the tunable component of a stringed musical instrument at the opposite end of the body, and separated from the body by the neck of the instrument. The tuning keys of the instrument are attached to the headstock. A tuning key includes a tuning key post around which an instrument string is wound, and a tuning knob—the portion of the tuning key that is grasped to turn the tuning key post to adjust the pitch of the string. In most guitars, the tuning knob is oriented at a ninety degree angle to the tuning key post by means of an intervening mechanical gear assembly located on the back of the headstock. The input to the gear assembly consists of a tuning knob shaft that terminates at the tuning knob. The output from the gear assembly consists of a tuning post shaft that penetrates the headstock and terminates at the tuning post on the string side of the headstock. Certain guitars, as well as other stringed musical instruments, have tuning keys in which the tuning knob is in a direct line with the tuning key post. In either case, the tuning knobs protrude laterally from the headstock.

The "first side" of the headstock refers to the side on which the strings are located, and the "second side" of the headstock refers to the opposing side of the headstock, which generally faces the musician. In a headstock in which there are two rows of tuning keys, the "third side" and "fourth side" of the headstock refer to the lateral sides of the headstock, generally perpendicular in alignment to the first side and second side, above which the tuning knobs project. In a headstock in which there is only one row of tuning keys, the "third side" is the side above which the tuning knobs project, and the "fourth side" is the opposing side of the headstock that typically has a contour giving the headstock a distinctive shape. The neck side of the headstock is that part which transitions into the neck of the instrument. The terminal side of the headstock is the end of the headstock furthest from and opposite the neck.

Figure 1:
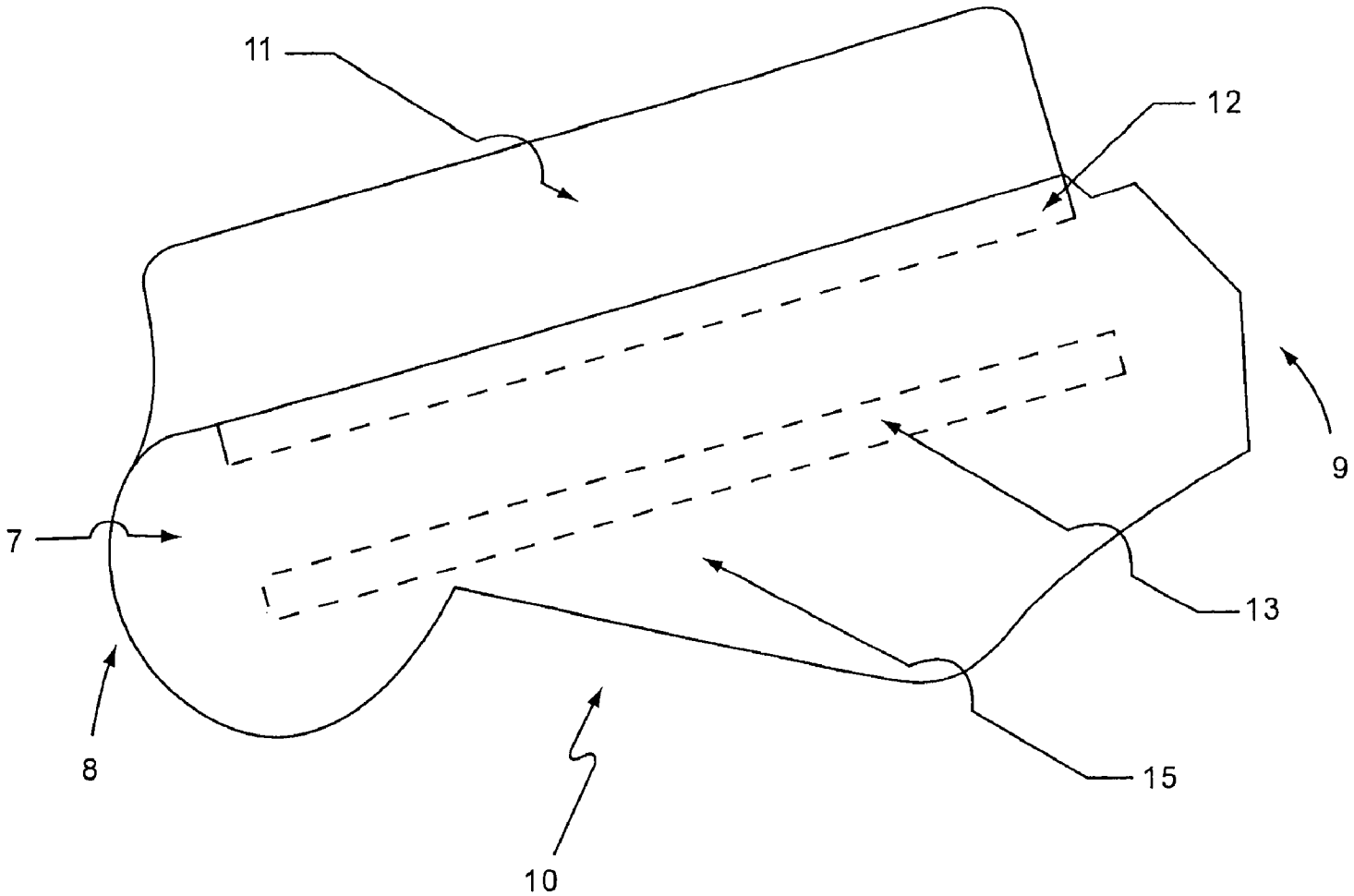
FIG. 1 shows a front view of a left-handed tuner cover for a guitar having a single row of tuning keys, one side having a tuner enclosure section, and the opposite side aesthetically shaped to conform to the contour of a particular guitar headstock.
Figure 2:
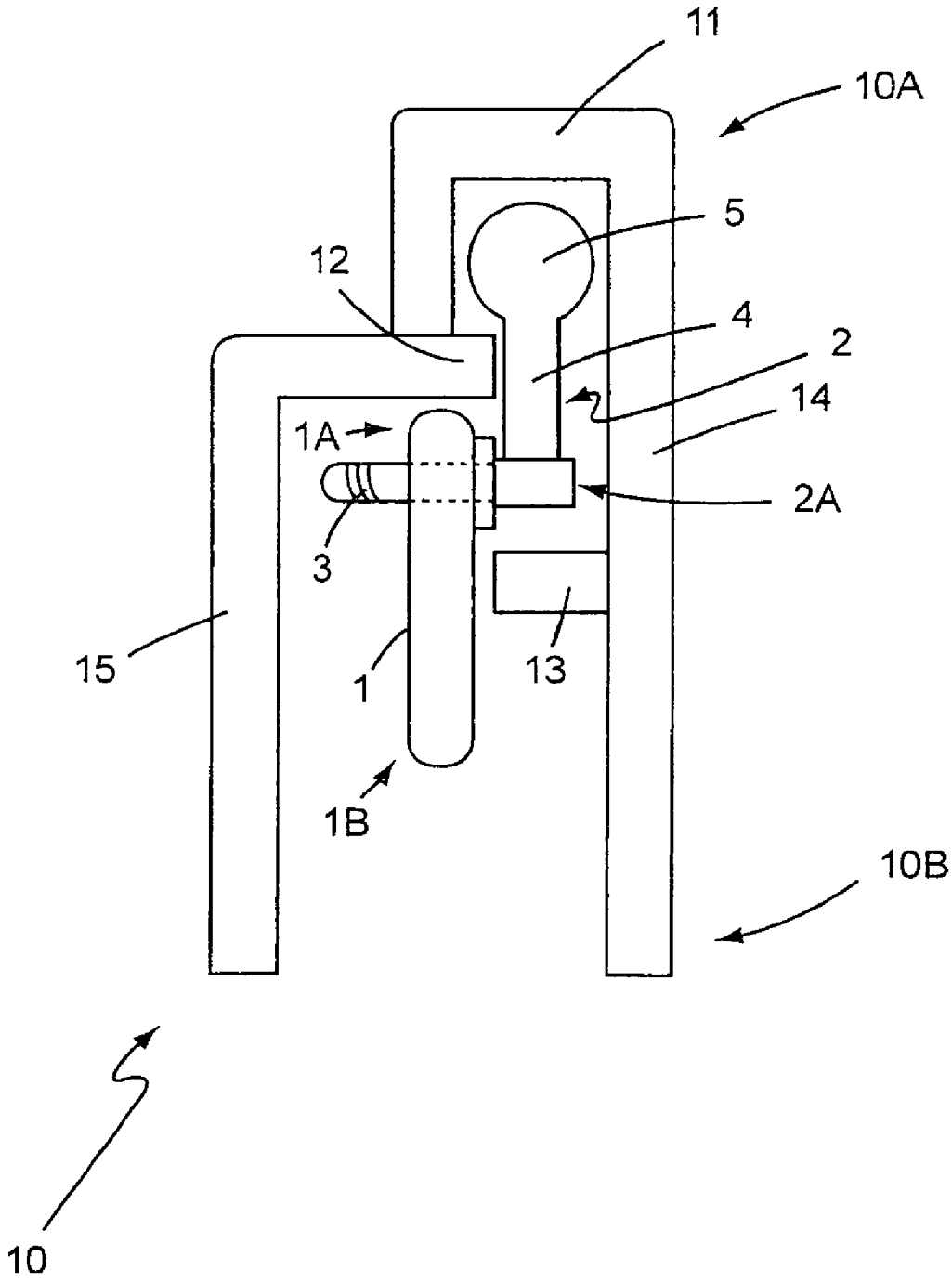
FIG. 2 shows a cross-sectional view of the tuner cover of FIG. 1, revealing the area of the tuner enclosure that surrounds the knobs of the tuning keys, and the open feature of the opposite side, which allows the tuner cover to be slid onto a guitar headstock.
Figure 3:
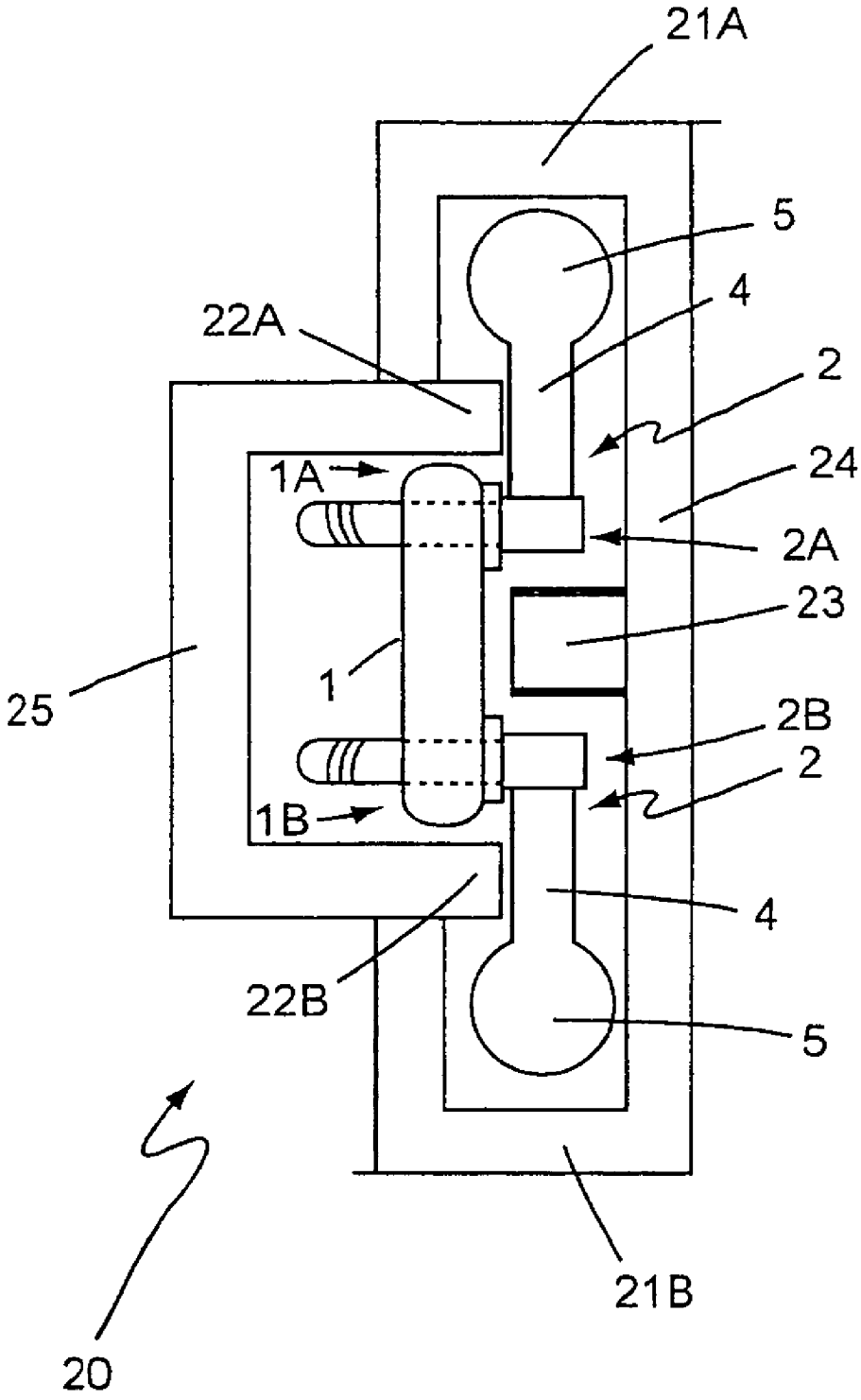
FIG. 3 shows a cross-sectional view of a tuner cover designed for a guitar having a row of tuning keys on both lateral sides of the headstock, which is capable of enclosing both rows of tuning knobs.

Referring to FIG. 1, a front view of tuner cover 10 shows how it can be shaped overall to mimic the appearance of the guitar headstock it is designed to cover. The tuner cover 10 has only a single tuner enclosure section 11 when all of the tuning keys are situated near one side (the third side) of the headstock. The opposing (fourth) side of the tuner cover 10 can be shaped to conform to the style of the headstock (here resembling the Fender Squier Stratocaster guitar headstock). FIG. 2 illustrates a cross-sectional view of the tuner cover 10 shows a tuner enclosure section 11 and two stabilizer/cover sections 14 and 15. One stabilizer/cover section, the first side stabilizer/cover 15, encloses at least part of the side of the instrument headstock (first side) on which the strings are situated. A second stabilizer/cover section, the second side stabilizer/cover 14, encloses at least part of the opposing second side of the instrument headstock. In a tuner cover 10 for a headstock with a single row of tuning keys, a tuner enclosure section 11 spans the space at the third side 1A of the headstock 1 between first side stabilizer/cover 15 and the second side stabilizer/cover 14. As shown in FIG. 3, the tuner cover 20 can alternatively include two tuner enclosure sections 21A and 21B, corresponding to the third side 1A and the fourth side 1B, respectively, of the headstock 1 and spanning the space between the first side stabilizer/cover 25 and the second side stabilizer/cover 24, in order to accommodate stringed instruments with tuning keys near both the third side 1A and the fourth side 1B of the headstock 1.

Returning to FIG. 2, the tuner cover 10 can incorporate a tuner interlock bar 12 that projects inwardly from the enclosure side of the first side stabilizer/cover 15. In single-row tuning key arrangements, the interlock bar 12 is configured to jut over the third side 1A of the instrument headstock 1 and make contact with the tuning knob shafts 4 of the tuning keys 2. The jutting side of the interlock bar 12 could also make contact with the third side 1A of the headstock 1. Alternatively (not shown), the face 12 of the interlock bar 12 can be positioned to make contact with the first side of the headstock 1 near its third side 1A. The tuner cover 10 can additionally incorporate a second side stabilizer/cover guide rail 13 that projects inwardly from the enclosure side of the second side stabilizer/cover 14. The guide rail 13 is configured to make contact with the second side of the instrument headstock 1, near the attachment points of the tuning keys 2A. The interlock bar 12 and the guide rail 13 contact the instrument headstock 1 and/or the tuning knob shafts in a manner to ensure a secure fit of the tuner cover 10 over the tuning knobs 5 of the tuning keys 2. Thus, any contact between the tuning knobs 5 and tuner enclosure 11 is prevented during movement of the instrument.

In single-row tuning key arrangements as shown in FIG. 2, the tuner cover 10 is preferably open over the fourth side 1B of the instrument headstock 1. In many guitars, the fourth side 1B of the headstock opposite the third side 1A (tuning key side) is aesthetically shaped. Preferably, the fourth sides of the first side stabilizer/cover 15 and second side stabilizer/cover 14 of the tuner cover 10 are shaped to conform to the shape of this side of the headstock, as shown in FIG. 1. The neck end 9 of the tuner cover 10 closest to the neck of the instrument is open, allowing the tuner cover 10 to be slid onto the terminal end of the headstock, and advanced toward the neck to completely cover the headstock. The terminal end 8 of the tuner cover 10 can enclose the terminal end of the instrument headstock by means of a terminal headstock cover 7 extending from the first side stabilizer/cover 15 to the second side stabilizer/cover 14 on that end. Preferably, the terminal headstock cover 7 is shaped to conform to the contour of the terminal end of the headstock, as shown in FIG. 1.

A tuner cover 10 as shown in FIG. 1 can be installed by sliding it onto the instrument headstock from its terminal end. Referring to FIG. 2, the user aligns the tuner interlock bar 12 with the third side 1A of the headstock 1 and the tuning knob shafts 4, and aligns the guide rail with the second side of the headstock below the attachment points 2A of the tuning keys 2 to the headstock 1. The tuner enclosure 11 is spacious enough to avoid making contact with the tuning knobs 5 above the third side 1A of the headstock 1. The tuner cover 10 is slid onto the headstock 1 until the terminal end 8 of the tuner cover 10 meets the terminal end of the headstock 1, or at least until all of the tuning keys 2 are covered by the tuner enclosure 11.

Figure 4:
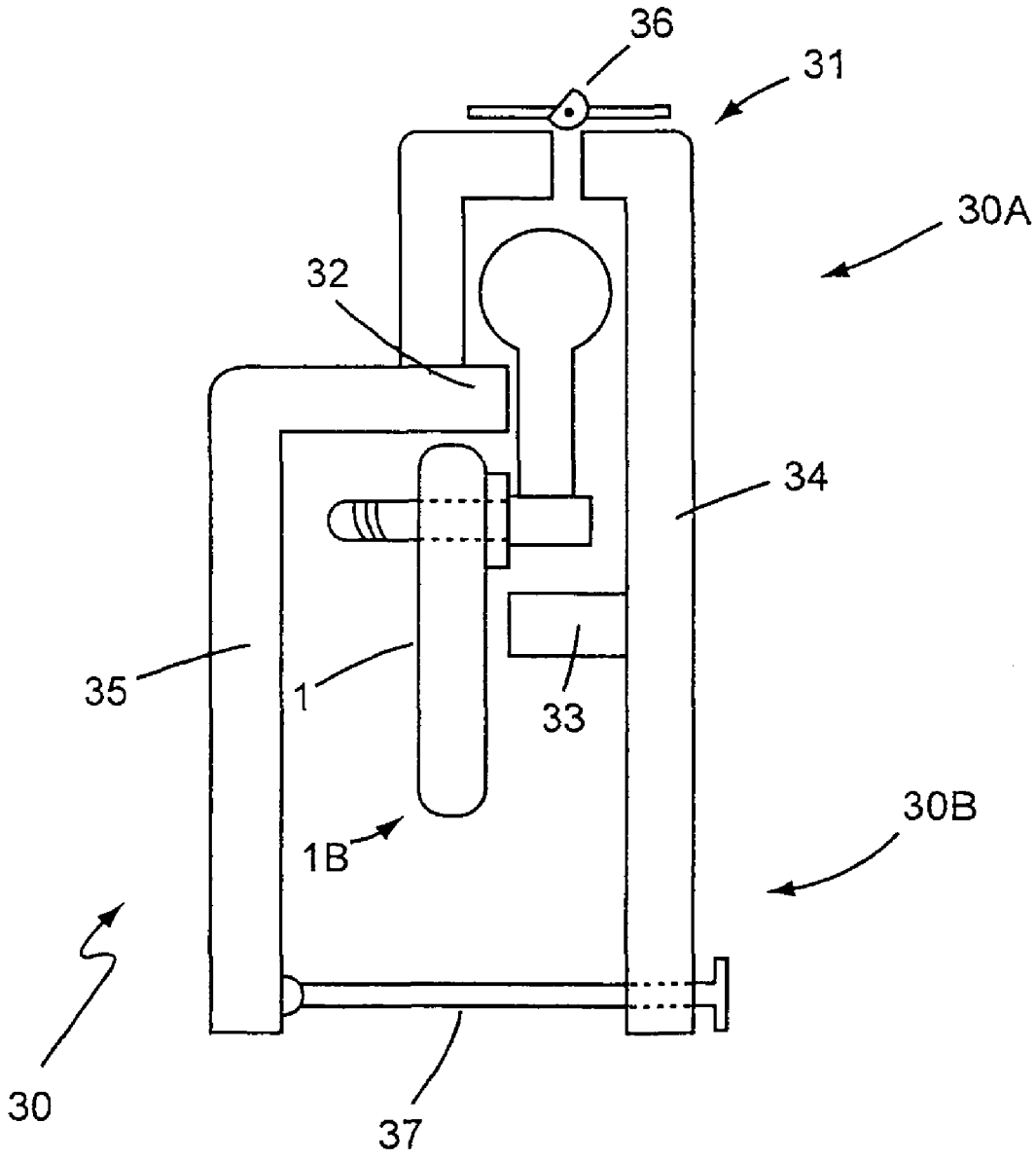
FIG. 4 shows a cross-sectional view of a tuner cover for a headstock having a single row of tuning keys, assembled by joining the first side stabilizer/cover to the second side stabilizer/cover with a hinge on the same side as the tuning keys and a latch on the opposite side.

Turning to FIG. 4, the first side stabilizer/cover 35 and second side stabilizer/cover 34 of the tuner cover 30 can be hinged on the tuner enclosure side 31, allowing the tuner cover 30 to open and close in a bivalve or clamshell manner over the instrument headstock 1. Alternatively (not shown), the hinges 36 can be located on other portions of the third side 30A of the first side stabilizer/cover 35 or second side stabilizer/cover 34 of the tuner cover 30 near the tuner enclosure 31. An advantage of a hinged tuner cover is that the first side stabilizer/cover 35 and second side stabilizer/cover 34 can be constructed less expensively (for example, using injection molding techniques), and then assembled into the tuner cover 30 by attaching hinges 36 to the tuner enclosure side 31 of the first side stabilizer/cover 35 and second side stabilizer/cover 34. A hinged tuner cover 30 also allows the fourth side 30B of the first side stabilizer/cover 35 and second side stabilizer/cover 34 to alternatively (not shown) angle inwardly toward each other to completely enclose the fourth side 1B of the headstock 1. A latching mechanism or other locking feature can then releasably lock the fourth sides of the first side stabilizer/cover 35 and second side stabilizer/cover 34 together. Alternatively, the lower lateral side 30B of the tuner cover 30 can be secured by a locking bar or rod 37, as long as the fourth sides of the first side stabilizer/cover 35 and second side stabilizer/cover 34 extend sufficiently to clear the fourth side 1B of the headstock 1.

Referring now to FIG. 3, the tuner cover 20 can be adapted for use with stringed instruments having tuning keys on both sides 1A and 1B of the headstock 1. For example, the tuner cover 20 can have two tuner enclosures 21A and 21B, one each for the separate rows of tuning keys 2. There can also be two tuner interlock bars 22A and 22B projecting inwardly from the enclosure side of the first side stabilizer/cover 25. Each interlock bar 22A and 22B can be configured to jut over the sides 1A and 1B of the instrument headstock 1, with the faces of the interlock bars 22A and 22B making contact with the tuning knob shafts 4 of the tuning keys 2. The jutting sides of the interlock bars 22A and 22B can also be constructed to make contact with the sides 1A and 1B of the headstock 1. The faces of the interlock bars 22A and 22B alternatively could make contact with the first side of the headstock 1, each interlock bar situated near its corresponding side 1A and 1B of the headstock 1. The tuner cover 20 can additionally incorporate a second side guide rail 23 that projects inwardly from the enclosure side of the second side stabilizer/cover 24. The second side guide rail 23 is configured to make contact with the second side of the instrument headstock 1, between the attachment points 2A and 2B of the tuning keys 2. The interlock bars 22A and 22B and the guide rail 23 contact opposite sides of the instrument headstock 1 and/or the tuning knob shafts 4, ensuring a secure fit of the tuner cover 20 over the tuning knobs 5 of the tuning keys 2, and preventing any contact from occurring between the tuning knobs 5 and the tuner enclosures 21A and 21B during movement of the instrument.

Returning again to FIG. 2, the first side stabilizer/cover 15 and second side stabilizer/cover 14 alternatively can extend at the fourth side 10B sufficiently to cover a second row of tuning keys (not shown) near the fourth side 1B of the headstock 1. Leaving the fourth side 10B of the tuner cover 10 open assists in allowing the tuner cover 10 to be slid onto a headstock having two rows of tuning keys.

Figure 5:
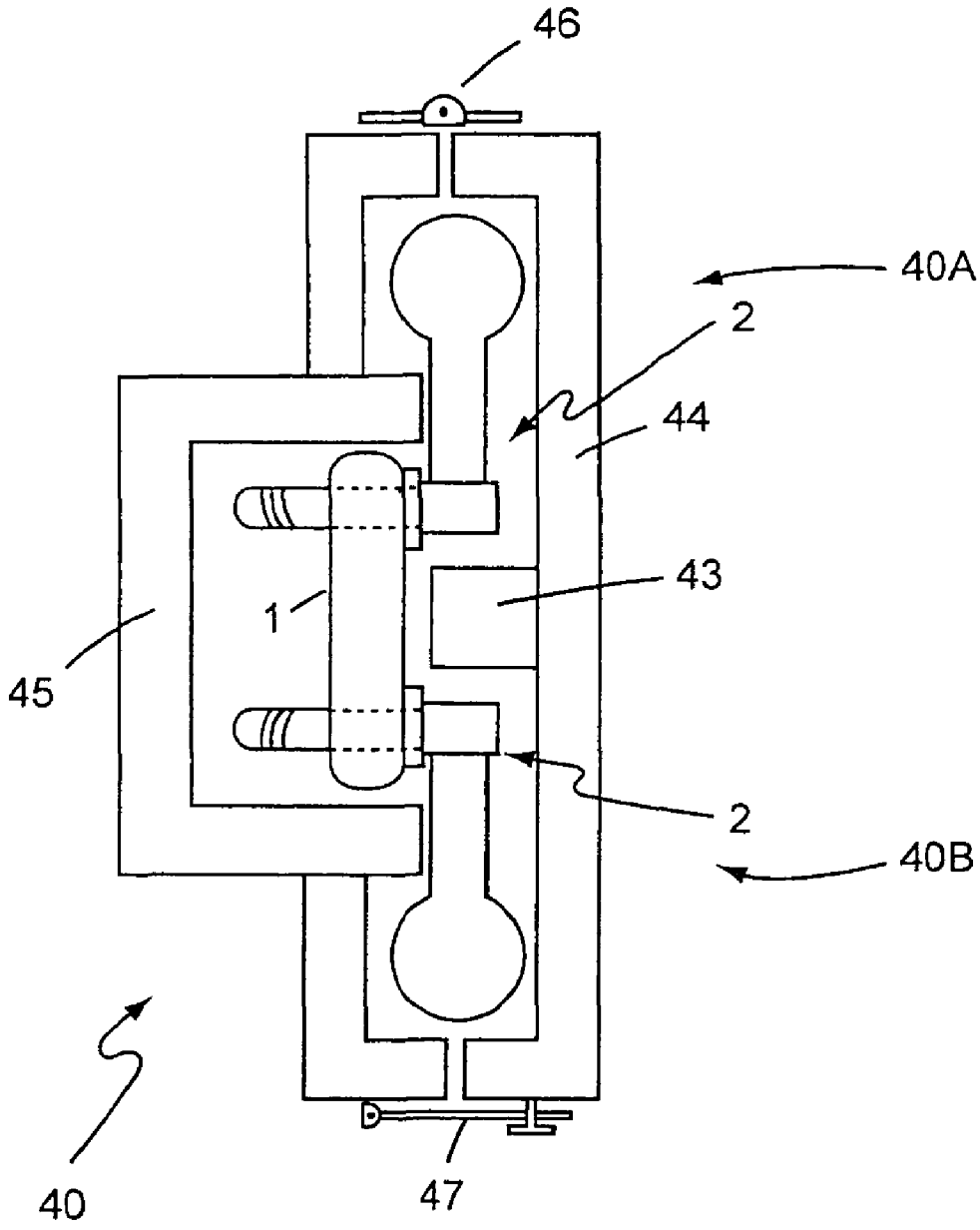
FIG. 5 shows a cross-sectional view of a tuner cover for a headstock having two rows of tuning keys, assembled by joining the first side stabilizer/cover to the second side stabilizer/cover with a hinge on one lateral (third or fourth) side and a latch on the opposing lateral side of the tuner cover.

As shown in FIG. 5, a hinged tuner cover 40 can accommodate an instrument having rows of tuning keys 2 on both sides 1A and 1B of the headstock 1. A hinged tuner cover 40 can be opened or closed over the headstock 1 without having to be slid over the headstock 1. A locking or latching mechanism 47 can be attached to the side opposite the hinge 46 to secure the tuner cover 40 in a closed position. In this case, the hinge can be placed on either first side 40*a* or second side 40*b* of the tuner cover 40. This design allows the tuner cover 40 to be made in a shape that conforms more closely to the overall contour of the headstock because the entire length of the tuner cover 40 does not have to slide past the widest point of the headstock 1, as shown in FIG. 1.

Alternatively, a hinge can be placed on the terminal end 7 of a tuner cover for a headstock having either a single row or dual row of tuning keys (not shown). A latching mechanism can be placed near the neck end 9 of the tuner cover. Also, the tuner cover can be constructed to exist as two separable components (e.g., first side plus second side), having two or more latches disposed at suitable complementary locations on the two components.

Figure 6C:
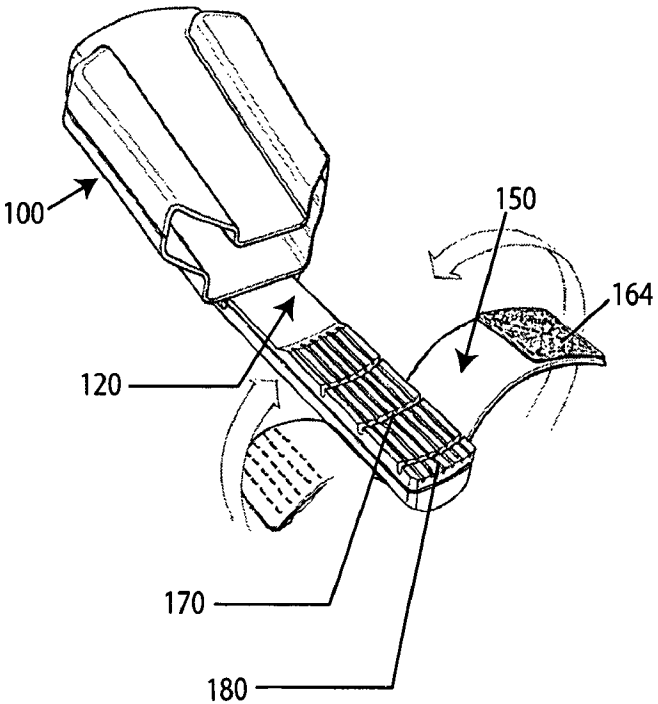
FIG. 6 shows three views (FIGS. 6*a, b* and *c*) of the combined tuner cover and arm for use with a musical instrument with an offset headstock.
Figure 6B:
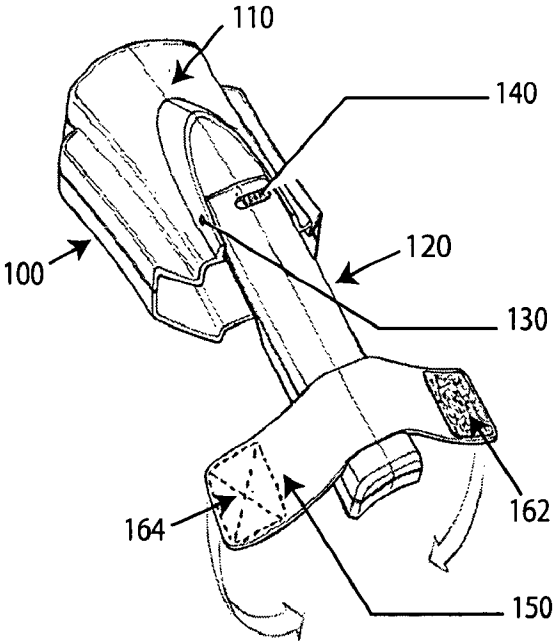
Figure 6A:
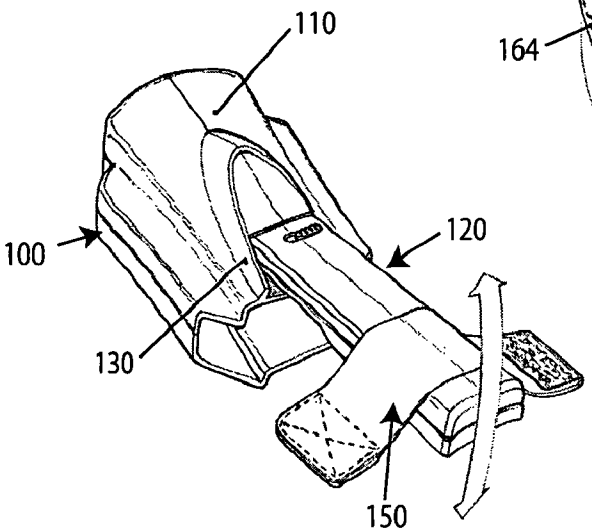

FIG. 6 shows three views of a combination device 100 having a tuner cover 110 and a support arm 120. While tuner cover 110 as shown in FIG. 6 is designed for a Gibson guitar, the same principles could be used for any stringed musical instrument. FIG. 6*a* show a tuner cover 110, which can be any of the tuner covers shown in FIGS. 1-5, or can be any even simpler device that protects the tuner keys on the headstock of the instrument. Device 100 shown in FIG. 6 includes a pivot 130 linking tuner cover 110 and support arm 120 in pivotal attachment. Pivot 130 allows tuner cover 110 to be attached to the musical instrument (not shown) by sliding over the headstock or using a hinge as in a clamshell form to obtain the proper location about the headstick before support arm 120 is pivoted in place against the neck of the musical instrument. FIG. 6*a* shows device 100 with support arm 120 pivoted away from the neck, while FIG. 6*b* shows support arm 120 pivoted to attach to the neck. Once support arm 120 is in its proper position, it can be locked in place by the optional lock mechanism 140. Lock mechanism 140 keeps the relative positions of tuner cover 110 and support arm 120 and allows proper energy transfer away from the fragile junction portion of the neck if the instrument is jarred or dropped. In FIG. 6, a slide lock mechanism 140 is shown but any type of device that can keep the relative positions of tuner cover 110 and support arm 120 about pivot 130 can be used. Alternatively, if tuner cover 110 and support arm 120 are formed as an integral piece, pivot 130 and lock mechanism 140 may not be needed.

After tuner cover 110 is in place and support arm 120 is put in its proper position and locked in place. a fastener is normally used to attach support arm 120 to the neck of the musical instrument. FIG. 6 shows a flexible fastening strap 150 that can encircle the neck of the musical instrument and helps keep support arm 120 in proper position. fastening strap 150 is shown as being attached by Velcro-type hook and eye fasteners 162 and 164 but any type of fastener could be used. Similarly, a rigid fastener could be used in lieu of flexible fastening strap 150.

As shown on FIG. 6*c* which illustrates support arm 120 from the opposite side, support neck 120 may have a series of grooves. For a stringed instrument with prominent fret bars, such as a guitar, fret grooves 170, which mate with the frets on the guitar, may be included. In addition, FIG. 6*c* shows string grooves 180 which mate with the strings of the guitar or other musical instrument to hold the strings in place without putting excessive or uneven pressure on the strings. Alternatively, a soft surface such as a rubber or foam pad could be used on support arm 120 where it supports the neck of the musical instrument, rendering the fret grooves 170 and string grooves 180 unnecessary.

While support arm 120 is shown as mating with the string side of the neck of the musical instrument, it also could be configured to support the neck by attaching to the back or side of the neck. This variant is particularly useful if the headstock is offset in two dimensions rather that just one.

The tuner covers depicted in FIGS. 2-6 can be constructed from a polymeric material (such as, for example, polycarbonate, plexiglass, plastic, or other composite material), wood, metal, or other suitable rigid or semi-rigid material. The material must bestow a sufficient degree of rigidity to the tuner cover to protect the enclosed tuning keys and tuning knobs from impact with external forces. The components (including, for example, the interlock bar, guide rail and tuner enclosure) can be assembled onto the string-side and back-side covers with adhesive, screws or other suitable fasteners. The reduced manufacturing costs associated with injection molding techniques may favor the construction and assembly of hinged tuner covers from component parts as depicted in FIGS. 4 and 5. After the components are produced and cooled, hinges and latches can then be applied to the first side and second side stabilizer/covers to complete the assembly. Alternatively, rather than using separately manufactured hinges, the hinged portion of the tuner enclosure can be constructed of a flexible polymer that allows repeated openings and closings of the first side and second side stabilizer/covers. The hinged portion may consist of a thinner and more flexible portion of the same material comprising the rest of the tuner cover, or it may be constructed from a different and inherently more flexible polymer, which is fused to the remainder of the tuner cover by an adhesive or any other suitable means. Any components that make contact with the headstock or tuning knob shafts (including, for example, the interlock bars and guide rails depicted in FIGS. 2-6) can be covered with a suitable soft material such as cotton, felt or other synthetic cloth or cushion, in order to prevent marring or wearing of the finish on the headstock or the tuning knob shafts.

The tuner cover and support arm can also be adapted and configured for stringed musical instruments having tuning knobs connected in a direct line with the tuning key posts. Many stringed instruments have this feature, including, for example, violins, violas, cellos, and bass instruments, as well as various plucked instruments. It is contemplated that further modifications in the tuner cover may be made without departing from the spirit and scope of the claimed invention. For example, it will be apparent to one skilled in the art that adjustments in the various dimensions of the tuner cover or its components will be necessary to accommodate variations in the shapes of headstocks of the various stringed instruments available on the market, including various types of guitars, cellos, basses, violins, violas, and the like.

INCORPORATION BY REFERENCE

The contents of all references, patents, pending patent applications and published patents, cited throughout this application are hereby expressly incorporated by reference.

EQUIVALENTS

Those skilled in the art will recognize, or be able to ascertain using no more than routine experimentation, many equivalents to the specific embodiments of the invention described herein. Such equivalents are intended to be encompassed by the following claims.

The invention claimed is:

1. A protective tuner cover and support arm for a stringed musical instrument, said stringed musical instrument having tuning knobs mounted on a headstock, said headstock being formed with a first side with the strings mounted thereon, an opposing second side, and third and fourth sides being substantially perpendicular in alignment to said first and second sides and being on opposing sides of said headstock from each other, at least one of said third and fourth sides having said tuning knobs being mounted thereon;

wherein said tuner cover comprises an elongate container adapted and configured to fit about at least a portion of said headstock and said tuning knobs, said tuner cover being shaped to cover at least a portion of said first and second sides of said headstock, and at least one tuner enclosure at one or both of said third or fourth sides, thereby enclosing said tuning knobs, and further comprising a support arm that is attached to said tuner cover and can be removably attached to the neck of said stringed musical instrument.

2. The tuner cover and support arm of claim 1 further comprising a tuner interlock bar projecting inwardly from the portion of said tuner cover to cover said first side and configured to contact at least one of said third or fourth sides of said headstock.

3. The tuner cover and support arm of claim 2, wherein the tuning knobs are mounted to the headstock by means of tuning knob shafts, and wherein the tuner interlock bar contacts the shafts of the adjacent tuning knobs.

4. The tuner cover and support arm of claim 2 further comprising a guide rail projecting inwardly from the portion of said tuner cover covering said second side and configured to contact said second side of the headstock.

5. The tuner cover and support arm of claim 1 wherein said support arm is pivotally connected to said tuner cover.

6. The tuner cover and support arm of claim 1 wherein said support arm comprises a fastener that removably connects the support arm to the neck of the stringed musical instrument.

7. The tuner cover and support arm of claim 6 wherein said fastener comprises a flexible strap the can encircle the neck of the stringed musical instrument.

* * * * *